US005601387A

United States Patent [19]

Sanford et al.

[11] Patent Number: 5,601,387

[45] Date of Patent: Feb. 11, 1997

[54] DEPTH ADJUSTING SYSTEM FOR A POWER TOOL

[75] Inventors: Christopher P. Sanford, Abingdon; Ashok S. Subramanian, Owings Mills, both of Md.

[73] Assignee: Black & Decker Inc., Newark, Del.

[21] Appl. No.: 486,665

[22] Filed: Jun. 7, 1995

[51] Int. Cl.[6] ..... B25B 21/00

[52] U.S. Cl. ..... 408/113; 81/429; 408/241 S

[58] Field of Search ..... 81/429; 408/14, 408/110, 113, 202, 241 S

[56] References Cited

U.S. PATENT DOCUMENTS

| | | | |
|---|---|---|---|
| 3,454,059 | 7/1969 | Sindelar | 81/429 |
| 3,527,273 | 9/1970 | Falter . | |
| 3,710,832 | 1/1973 | Lafferty, Sr. | 81/429 |
| 3,712,352 | 1/1973 | Lafferty, Sr. | 81/429 |
| 4,592,257 | 6/1986 | Dürr . | |
| 4,630,512 | 12/1986 | Durr | 81/429 |
| 4,647,260 | 3/1987 | O'Hara et al. . | |
| 4,809,572 | 3/1989 | Sasaki . | |
| 5,044,233 | 9/1991 | Tatsu et al. . | |
| 5,341,704 | 8/1994 | Klemm . | |
| 5,380,132 | 1/1995 | Parks . | |

FOREIGN PATENT DOCUMENTS

| | | | |
|---|---|---|---|
| 0265380 | 4/1988 | European Pat. Off. . | |
| 0401548 | 12/1990 | European Pat. Off. . | |
| 0448801 | 10/1991 | European Pat. Off. . | |
| 3330962 | 3/1985 | Germany | 81/429 |
| 3431630 | 3/1986 | Germany . | |
| 49807 | 3/1991 | Japan | 408/113 |

*Primary Examiner*—Daniel W. Howell

*Attorney, Agent, or Firm*—Harness, Dickey & Pierce, P.L.C.

[57] ABSTRACT

A depth adjusting system particularly for power-driven screwdrivers comprising an adjustment collar that is releasably fitted to the housing of the tool and a depth locator which screws onto the collar for non-rotational axial movement relative to the housing. The adjustment collar has a rearward cylindrical portion that includes an inner circumferential surface having a circumferential groove and a plurality of axially extending recesses. The depth adjusting system further comprises a pair of arcuate spring members attached to the nose portion of the housing and formed to include an arcuate rib portion for engaging the circumferential groove. The arcuate spring members also include a plurality of cantilevered spring fingers for biasing the arcuate rib portions into engagement with the circumferential groove. Further, the arcuate spring members are each formed to include detent projections adapted to engage one of the plurality of axially extending recesses for positively locating the subassembly with respect to the nose portion of the housing. The adjustment collar and depth locator subassembly may be removed from the housing as a unit without disturbing the depth setting through the application of axial force which causes the pair of arcuate spring members to flex inwardly against the bias of their cantilevered spring fingers.

20 Claims, 4 Drawing Sheets

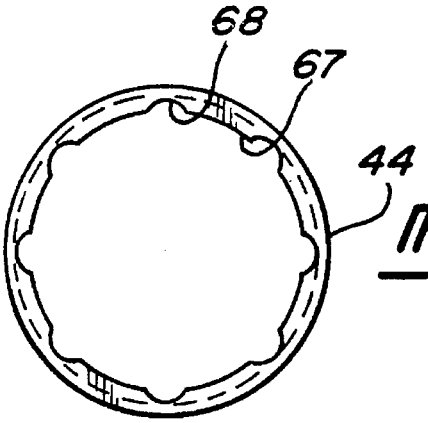
Fig - 6
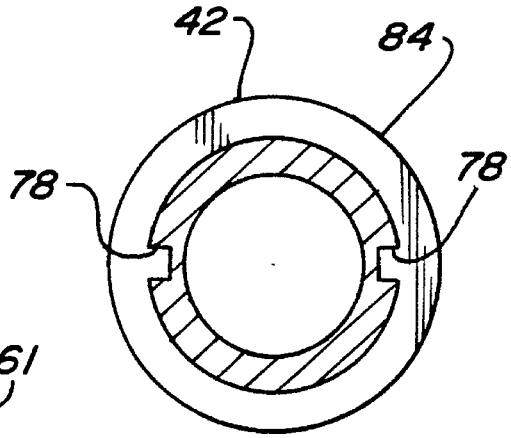
Fig - 7
Fig - 8
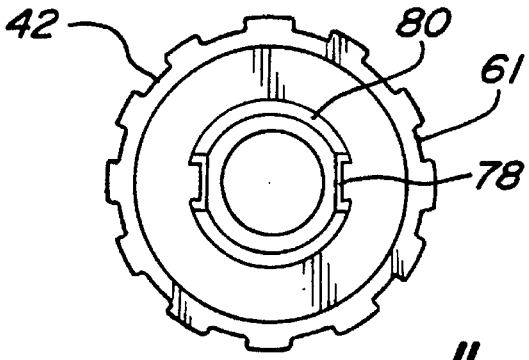
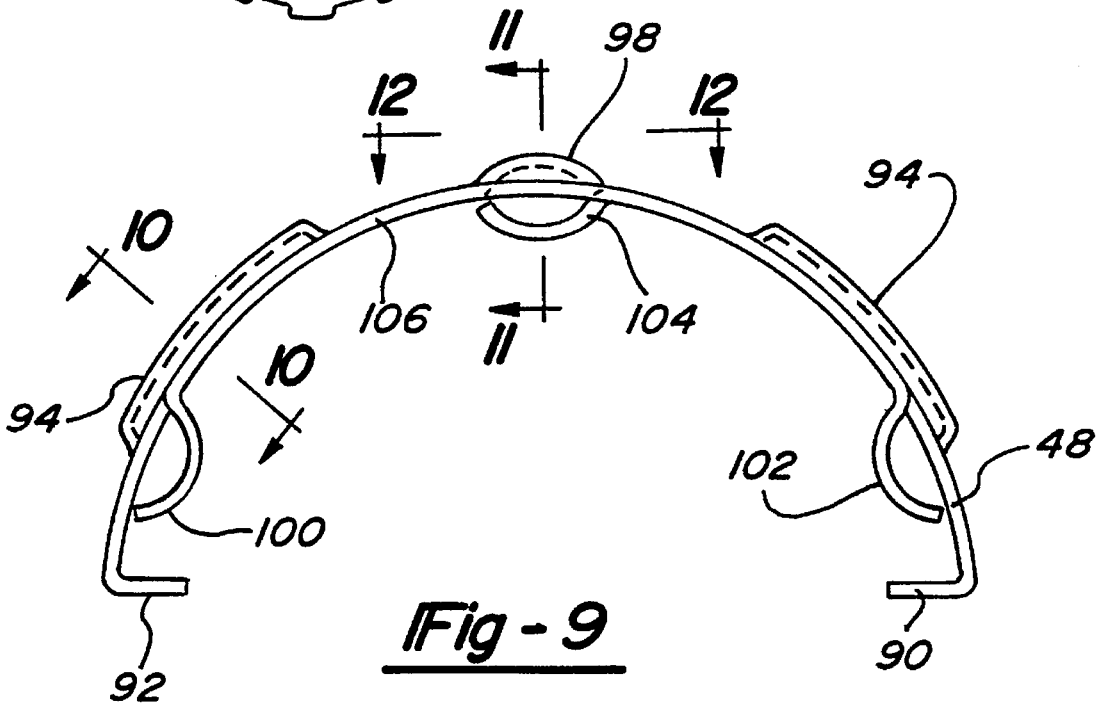
Fig - 9

DEPTH ADJUSTING SYSTEM FOR A POWER TOOL

BACKGROUND AND SUMMARY

The present invention relates in general to power tools. In particular, the present invention relates to a depth adjusting system for a power tool such as a power-driven screwdriver.

Power-driven screwdrivers frequently are equipped with depth locators that are releasably mounted to the nose of the tool and surround the screwdriver bit for adjustably setting the depth to which the head of a screw will be set into a workpiece. In particular, the axial position of the depth locator is typically adjustable relative to the tool bit so as to control the extent to which the screwdriver bit protrudes from the end of the depth locator. Consequently, as the screw is driven into the workpiece, the end of the depth locator will contact the surface of the workpiece thereby unloading the axial pressure on the screwdriver bit required to maintain engagement of a clutch mechanism in the power-driven screwdriver.

It is desirable for depth adjusting systems to be easily adjusted and also readily removable from the tool housing while maintaining the depth setting to enable the operator to conveniently replace the screwdriver bit. Known depth adjusting systems are shown in U.S. Pat. Nos. 4,647,260 to O'Hara et al., and 5,380,132 to Parks. These patents are both assigned to the assignee of record of the present invention and are expressly incorporated herein by reference.

The depth adjusting system disclosed in U.S. Pat. No. 4,647,260 comprises a two-piece molded plastic subassembly that is connected to the forward end of the housing of the power tool. The subassembly comprises an adjustment collar that is mounted to the nose portion coaxial with the tool bit so as to be restrained from axial movement but free to rotate relative to the housing, and a depth locator that is threadably connected to the adjustment collar and restrained from rotating relative to the housing but free to move axially relative to the housing in response to rotation of the adjustment collar. The adjustment collar is provided with an internal annular flange that is engageable through a snap-action with a retaining ring located on the nose portion of the housing. In addition, indexing means in the form of a plurality of circumferential resilient fingers are provided on the adjustment member for engaging detents on the nose portion of the tool and serve to settably maintain the adjustment member in a predetermined angular position relative to the housing. The resulting depth adjusting system disclosed in this patent enables an operator to disconnect the subassembly by unsnapping the adjustment member from the housing without disturbing the previously set depth adjustment.

U.S. Pat. No. 5,380,132 discloses a depth adjusting system for a power tool that comprises an adjustment collar releasably fitted to the housing of the tool and a depth locator which screws onto the collar. The adjustment collar has a forward cylindrical portion and an enlarged rearward cylindrical portion that includes a pair of diametrically opposed, axially extending cantilever spring fingers for detachably connecting the adjustment collar to a circular opening in the housing. The free ends of the spring fingers are provided with a hook and groove that are adapted to engage and mate with a corresponding circumferential groove and rib in the housing opening, thereby permitting relative rotation of the adjustment collar to the housing which serves to set the relative axial position of the depth locator. The adjustment collar and depth locator subassembly may be removed from the housing without disturbing the depth setting by depressing the spring fingers sufficiently to release the hooks from the groove in the housing.

While prior known devices such as those discussed above have proven to be commercially successful, it is further desirable, however, to provide a depth adjusting system that is convenient to remove from the nose portion of the housing and that provides components that are less subject to wear, thereby resulting in a system having reliability over a longer period of time.

The present invention comprises an improvement over prior known depth adjusting systems, including those disclosed in the aforementioned patents. More particularly, the present invention provides an improved interface between the depth adjusting subassembly and the forward end of the nose portion in the form of a pair of arcuate spring members. In the preferred embodiment, each of the arcuate spring members is constructed of hardened steel to reduce physical wear of the interface between the depth adjusting subassembly and the nose portion. In normal operation, the engagement of one or more arcuate ribs integrally formed into each of the arcuate spring members with an internal groove formed in an adjustment collar enables the adjustment collar to be freely rotated relative to the nose portion. Preferably, the arcuate spring members further include detent projections to positively maintain the adjustment member in a set angular position relative to the tool housing.

In one form, the depth adjusting system of the present invention is adapted for use with a power tool having a housing. The depth adjusting system includes a nose portion connected to the housing and a subassembly including an adjustment member connected to the nose portion for rotatably non-axially movement relative to the nose portion during depth adjusting movement of the adjustment member. The depth adjustment system additionally includes a depth locator member interconnected with the nose portion for axially slidable, non-rotatable movement relative to the nose portion during depth adjusting movement of the adjusting member. Further, the depth adjusting system includes a joining member for establishing releasable interconnection between the subassembly and the nose portion. The joining member includes a substantially rigid portion engaging the subassembly and a resilient portion for biasing the substantially rigid portion into engagement with the subassembly.

In a preferred form, the depth adjusting system of the present invention includes a nose portion connected to the housing and a depth adjusting subassembly for establishing a predetermined depth for setting a threaded fastener into a workpiece. The depth adjusting subassembly is releasably connected to the nose portion and includes an adjustment collar rotatably coupled to the nose portion for non-axial movement relative to the nose portion during depth adjusting movement, and a depth locator. The adjustment collar includes an inner circumferential surface defining a circumferential groove. The depth locator is threadably connected to the adjustment collar and constrained from rotating relative to the nose portion so that rotation of the adjustment collar causes axial displacement of the depth locator. The system further includes a pair of substantially identical arcuate spring members attached to the nose portion. Each of the arcuate spring members include at least one arcuate rib portion adapted to engage the circumferential groove of the adjustment collar. The arcuate spring members are additionally formed to include a plurality of cantilevered spring fingers for providing an outward bias. Further preferably, the inner circumferential wall includes a plurality of axially extending channels and the arcuate spring members include a detent projection. The detent projections and the axially extending channels cooperate to positively locate the adjustment member axially with respect to the nose portion.

BRIEF DESCRIPTION OF THE DRAWINGS

Additional objects and advantages of the present invention will become apparent from a reading of the following detailed description of the preferred embodiment which makes reference to the drawings of which:

FIG. 6 is a rear elevational view of the adjustment collar taken in the direction of line 6—6 of FIG. 3;

FIG. 7 is a front elevational view of the nose portion taken in the direction of line 7—7 of FIG. 4;

FIG. 8 is a transverse sectional view of the nose portion taken along line 8—8 in FIG. 4; and FIG. 9 is a front elevational view of one of the arcuate spring members of the present invention;

DETAILED DESCRIPTION OF THE PREFERRED EMBODIMENT

The present invention provides an improved depth adjusting system for a power tool. While shown in a depth adjusting system adapted to a power screwdriver, those skilled in the art will appreciate that the invention is not so limited in scope and is readily adaptable for use with any power tool (e.g., screwdrivers, nut-runners, etc.) for rotationally advancing a fastener to a predetermined depth.

Figure 1:
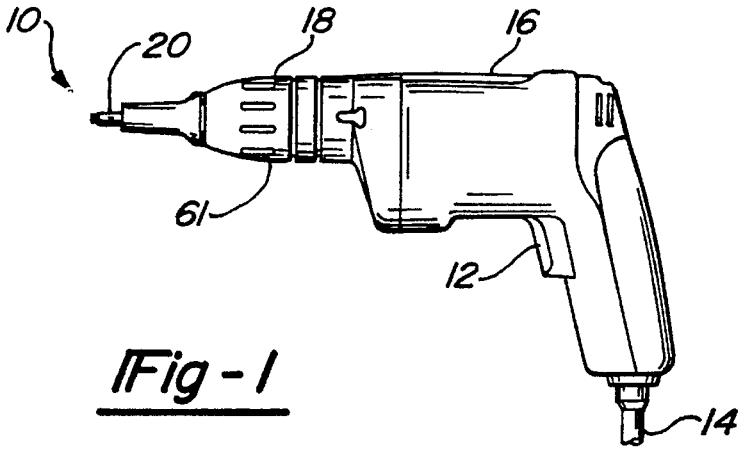
FIG. 1 is a side elevational view of a power screwdriver incorporating a depth adjusting system constructed in accordance with the teachings of the preferred embodiment of the present invention.

Turning to the drawings in which identical or equivalent elements have been denoted with like reference numerals, an exemplary tool embodying the present invention is illustrated in FIG. 1 as a power screwdriver and is identified generally at reference numeral 10. The tool 10 is powered by a motor (not shown) actuated by a trigger switch 12 which controls delivery of electrical energy to the motor through a power cord 14.

Figure 2:
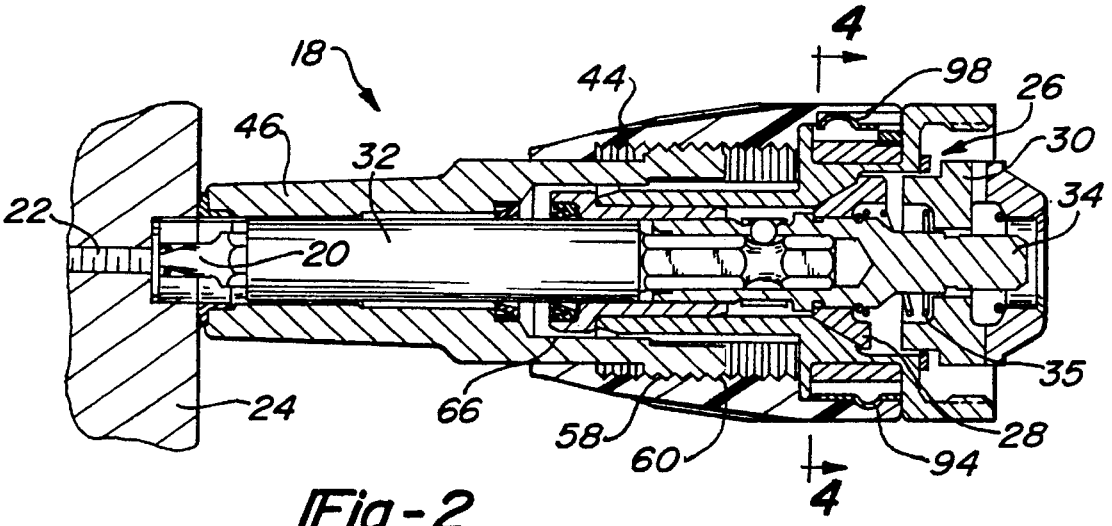
FIG. 2 is a sectional detail view of the depth adjusting system of the present invention shown in operative cooperation with a threaded fastener and workpiece.

Power tool 10 includes a housing 16 which is connected a depth adjusting system 18 constructed in accordance with the teachings of a preferred embodiment of the present invention. A tool bit 20 having a predetermined axial length is connected to power tool 10 and extends outwardly from depth adjusting system 18. In the embodiment illustrated, the tool bit is an interchangeable screwdriver bit 20, and is shown in FIG. 2 in driving engagement with a threaded fastener 22. Depth adjusting system 18 is particularly adapted for rotationally advancing such a threaded fastener to a predetermined depth into a workpiece 24. Fastening of two workpieces such as such as drywall and a wall joist, may be expedited through the ability to quickly advance a threaded fastener to a predetermined depth. In addition, the quality of such applications improves were the threaded fasteners are accurately advanced to a uniform depth.

As shown in FIGS. 1 and 2, the screwdriver bit 20 is rotationally driven through an internal clutch mechanism 26. Internal clutch mechanism 26 includes a pair of clutch plates 28, 30 and a screwdriver bit holder 32 spring-biased outwardly from a drive spindle 34 by a coil spring 35. Depth adjusting system 18 controls the depth of penetration of threaded fastener 20 into workpiece 24 by permitting internal clutch mechanism 26 to become disengaged (i.e. clutch plates 28, 30 separate) when threaded fastener 22 advances to the predetermined depth. While not specifically shown in the drawings, it will be appreciated by those skilled in the art that spindle 34 is adapted to be powered through a gear train which is in turn driven by a drive pinion formed on the motor's armature shaft. For a more detailed description of a drive arrangement suitable for use with the depth adjusting system of the present invention, reference may be had to U.S. Pat. No. 4,647,260. However, the depth adjusting system 18 of the present invention is operable with any drive arrangement in which driving power transferred to screwdriver bit 20 is interrupted upon a predetermined axial displacement of the screwdriver bit 20.

As shown in FIGS. 2 through 6, the elements of depth adjustment system 18 of power tool 10 are shown to include a depth adjusting subassembly 40 connected with a snap-action to a nose portion 42 of housing 16. The arrangement of depth adjusting system 18 permits an operator to easily remove depth adjusting subassembly 40 without requiring more than a single axial motion, indicated by arrow A in FIG. 3, to separate (or reconnect) the depth adjusting subassembly 40 from (or to) nose portion 42. Further, depth adjusting system 18 can be removed without any additional tools. Thus, the operator can replace tool bit 15 without disturbing depth adjustment setting. This quick and easy removal is accomplished by interconnecting the elements of depth adjusting subassembly 40 so that depth adjusting subassembly 40 is removable from nose portion 42 as a unit.

Depth adjusting subassembly 40 of the present invention is shown to include a first member, namely, a molded plastic adjustment member or adjustment collar 44. The first member 44 carries with it a second member, namely a locator member or depth locator 46. Depth adjusting subassembly 40 is further shown to include a pair of joining members 48. In the preferred embodiment, the pair of joining members comprises a pair resilient arcuate spring members 48.

Adjustment collar 44 is a one-piece molded plastic member having a front cylindrical portion 50 connected to a rear cylindrical portion 52 at a junction 54. Front cylindrical portion 50 defines a set of internal depth adjusting threads 56 which engage mating threads 58 formed on a rear external surface 60 of depth locator 46, the second member of depth adjusting subassembly 40. As shown in FIG. 1, raised ribs 61 are integrally formed on the outer surface of adjustment collar 44 of depth adjusting subassembly member 40. Ribs 61 cooperate with the enlarged size of the adjustment collar to enable the operator to more easily alter the depth adjustment setting of the system 10 through angular positioning of adjustment collar 44.

Depth locator 46 includes a workpiece-engaging portion 62 formed forwardly of external threads 58 which includes a wear surface such as metal insert 64. As best shown in the cross-sectional view of FIG. 5, depth locator 46 further defines a pair of integral keys 66 longitudinally extending on the inner surface. Internally, depth locator 46 includes an internal bore for axially receiving screwdriver bit holder 32.

Figure 3:
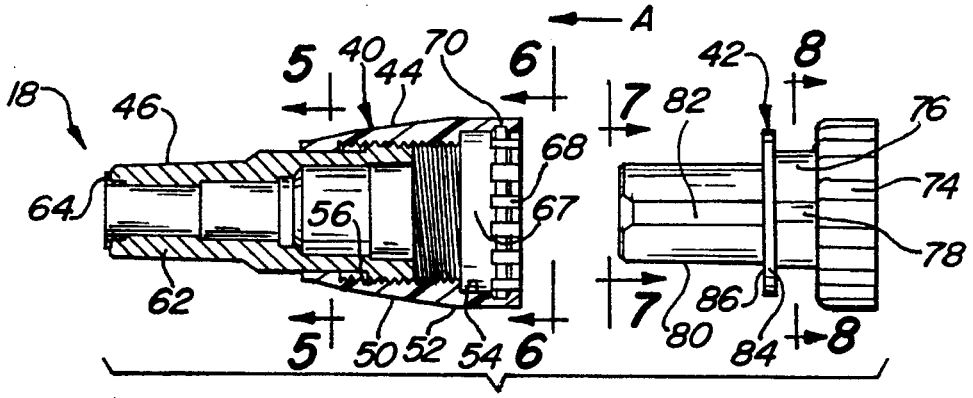
FIG. 3 is an exploded view shown in partial cross-section of the depth adjusting subassembly of FIG. 1 with the arcuate spring members removed for clarity.
Figure 4:
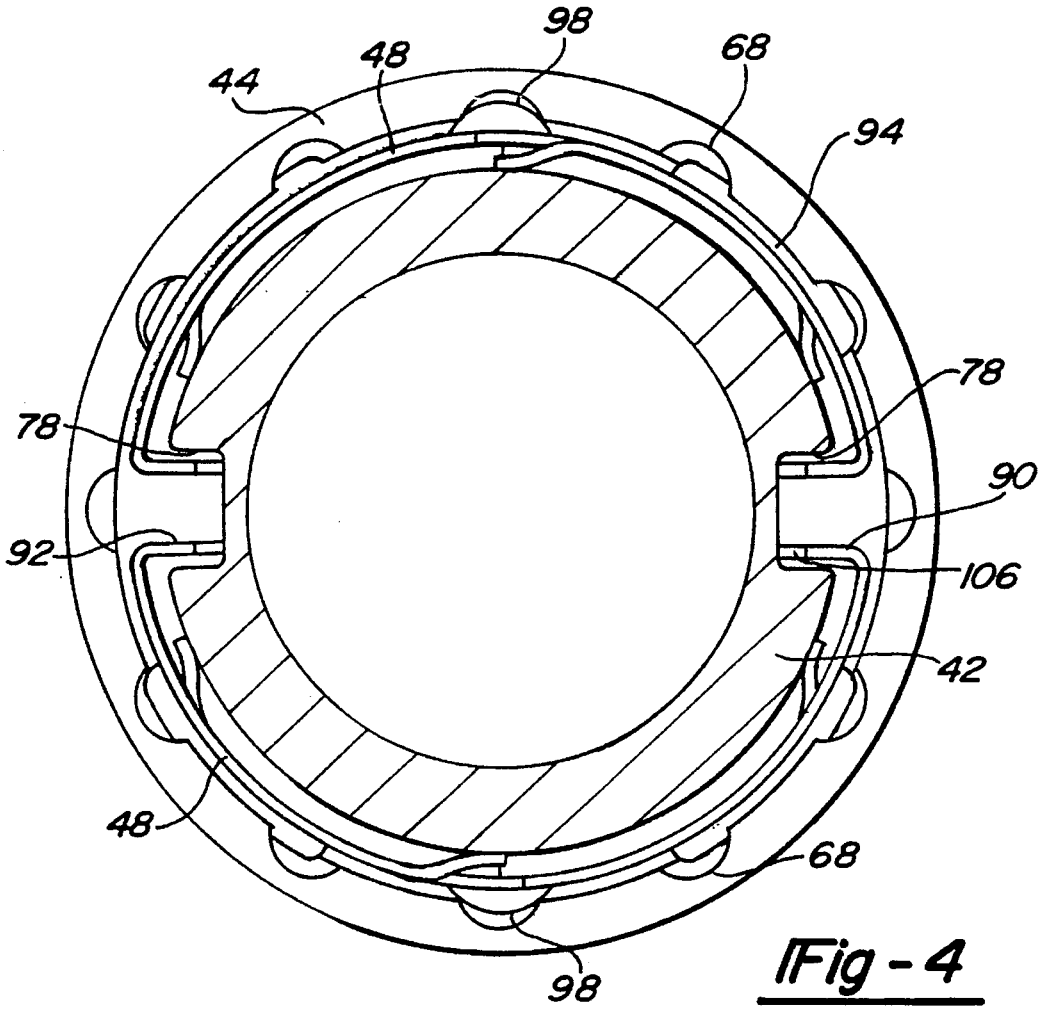
FIG. 4 is a transverse sectional view of the depth adjusting system taken along line 4—4 of FIG. 1.
Figure 5:
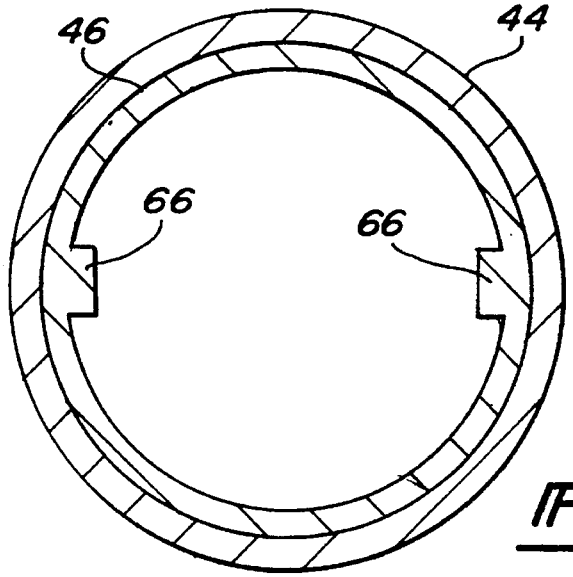
FIG. 5 is a transverse sectional view of the adjustment collar and depth locator taken along line 5—5 of FIG. 3.
Figure 10:
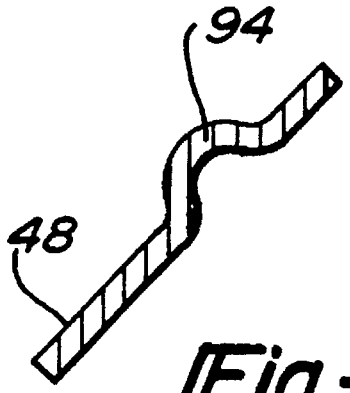
FIG. 10 is a sectional view of the arcuate spring member taken along the line 10—10 of FIG. 9.
Figure 11:
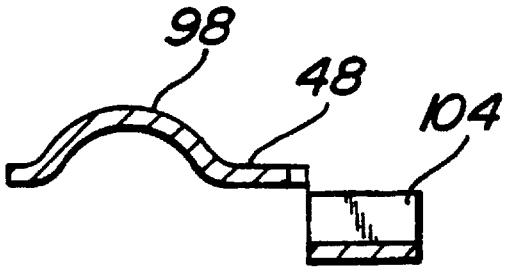
FIG. 11 is a sectional view of the arcuate spring member taken along the line 11—11 of FIG. 9.
Figure 12:
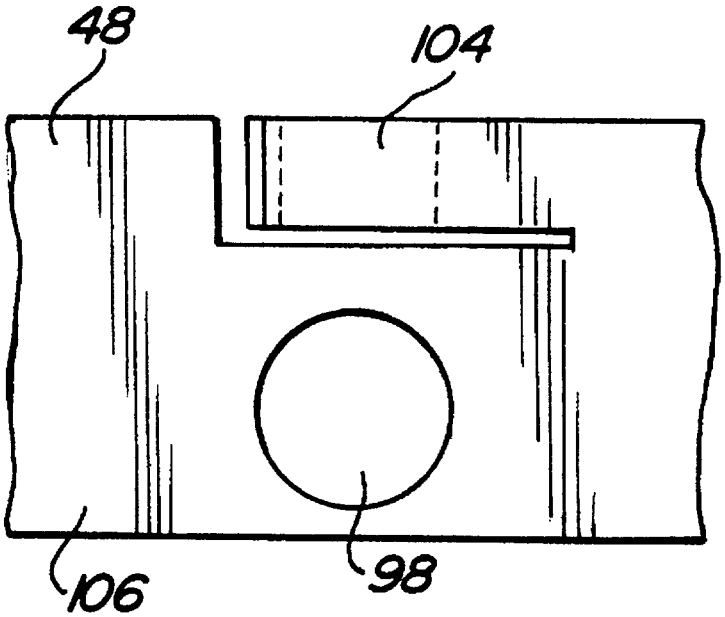
FIG. 12 is an elevational view of the arcuate spring member taken in the direction indicated by the line 10—10 of FIG. 9.

As best shown in FIGS. 3 and 4, and as will become more apparent below, rear cylindrical portion 52 of adjustment collar 44 defines an inner circumferential surface 67 configured to cooperate with the pair of arcuate spring members 48 for resiliently mounting depth adjusting subassembly 40 (e.g., adjustment member 44 and depth locator 46) on nose portion 42. More particularly, inner circumferential surface 67 defines a circumferentially extending groove 70 for axially retaining depth adjusting subassembly 40 in operative relationship with nose portion 42. Inner circumferential surface 67 further defines a plurality of equally spaced, axially extending recesses 68 for positively locating adjustment collar 44 with respect to depth locator 46. In one application, adjustment collar 44 defines eight (8) such axially extending recesses 68 equally spaced about inner circumferential surface 67.

Nose portion 42 includes an annular assembly gripping portion 74 adjacent to the housing 18, and further includes a centrally located circumferential groove 76. A pair of axially extending channels 78 are recessed into diametrically opposed sides of circumferential groove 76. Nose portion 42 additionally includes a front portion 80 extending axially forward of circumferential groove 76 and defining two axially-extending grooves 82 or keyways complimentary with the longitudinal keys 66 integrally formed in depth locator 46. A circumferential flange portion 84 is interdisposed between front portion 80 and circumferential groove 76 and includes a front surface 86 adapted to abut junction 54 of adjustment collar 44. In the exemplary embodiment illustrated, nose portion 42 is shown integrally formed with housing 16. However, it will be appreciated by those skilled in the art that nose portion 42 may alternatively be attached to the remainder of housing 16 through threads, fasteners or any other suitable mechanical fastening mechanism.

Arcuate spring members 48 are substantially identical and are retained within circumferential groove 76 of nose portion 42. In use, arcuate spring members 48 cooperatively engage inner circumferential surface 67 of adjustment collar 44 to perform dual functions. More particularly, arcuate spring members 48 function to retain adjustment subassembly 18 on nose portion 42 and additionally function to positively locate adjustment collar 44 rotationally with respect to nose portion 42, and thereby positively locate depth locator 46 axially with respect to nose portion 42. In the preferred embodiment, each of the arcuate spring members 48 is constructed of hardened steel.

As arcuate spring members 48 are substantially identical, the construction of a single arcuate spring member 48 only will be described by reference to FIGS. 4 and 9–12. Arcuate spring member 48 has a pair of inwardly extending catch portions 90, 92 that are hooked into axially extending channels 78 (as best shown in FIG. 4) on nose portion 42. In the preferred embodiment, the tips 106 of the catch portions 90, 92 are tapered and are adapted to mate with cooperating portions (not shown) of axially extending channels 78 to prevent arcuate spring member 48 from backward installation. In this regard, arcuate spring member 48 must be positioned within circumferential groove 76 with arcuate ribs 94 adjacent gripping portion 74. Otherwise, arcuate ribs 94 would not engage channel 70.

Arcuate spring member 48 is integrally formed to include a substantially rigid engagement portion 94 for releasably retaining depth locator 46 and adjustment collar 44 to nose portion 42. In the preferred embodiment, the substantially rigid engagement portion preferably comprises a plurality of arcuate retaining ribs 94 adapted to engage circumferentially extending groove 70 in adjustment collar 44. Further in the preferred embodiment, arcuate spring member 48 is integrally formed to include two (2) arcuate ribs 94.

Arcuate spring member 48 is further formed to include a detent portion 98 for indexing the rotational position of adjustment collar 44 relative to nose portion 42. In the preferred embodiment, the detent portion comprises one or more radially extending detent projections 98. In operation, the rotational position of adjustment collar 44 relative to nose portion 42 and depth locator 46 is positively located by detent projections 98 on arcuate spring members 48 which cooperate with the plurality of mating axially extending recesses 68 formed in circumferential surface 67 of adjustment collar 44. Detent projections 98 are integrally formed with arcuate spring member 48 and in the preferred embodiment are themselves non-compressible.

To permit arcuate spring members 48 to resiliently flex when adjustment collar 44 is rotated relative to nose portion 42 and when adjustment collar 44 is attached to or removed from nose portion 42, arcuate spring members 48 are formed to include resilient portions. In the preferred embodiment, the resilient portions comprise a plurality of cantilevered spring fingers 100, 102, 104 (shown most clearly in FIGS. 8 and 11). Further in the preferred embodiment, arcuate spring member 48 includes three cantilevered spring fingers 100, 102, 104. Fingers 100, 102 are formed along a forward wall 106 of arcuate spring member 48 and finger 104 is formed along a rear wall 108 of arcuate spring member 48. Fingers 100, 102, 104 engage an annular wall of circumferential groove 76 of nose portion 42 and resiliently bias arcuate spring member 48 outwardly and into frictional engagement with adjustment collar 44.

When attaching adjustment collar 44 to nose portion 42, it is necessary to rotate adjustment collar 44 relative to nose portion 42 until locator keys 66 are angularly aligned with corresponding keyways 82 of nose portion 42. Next, it is necessary to angularly align detent projections 94 on each arcuate spring member 48 with a mating collar recess 68. When depth adjusting subassembly 40 is snapped onto the nose portion 42, the respective surfaces of depth adjusting subassembly 40 and nose portion 42 coact as follows: Forwardly extending portion 80 of nose portion 42 enters adjustment collar 44. Simultaneously, integral keys 66 of depth locator 46 engage and advance along complimentary keyways 82 on front portion 80 of nose portion 42. As depth adjusting subassembly 40 is moved an additional axially distance onto nose portion 42, arcuate spring members 48 engage adjustment collar 44. Next, arcuate ribs 94 engage inner circumferential surface 67 of adjustment collar 44, thereby flexing arcuate spring members 48 inwardly against the outward bias of cantilevered spring fingers 100, 102, 104. This outward bias of cantilevered spring fingers 100, 102, 104 cause arcuate ribs 94 to resiliently engage circumferentially extending groove 70 upon complete advancement of subassembly 44 with respect to nose portion 42, thereby axially retaining subassembly 44.

Depth locator 46 is now axially slidable but nonrotatably mounted with respect to nose portion 42 through keys 66 and corresponding keyways 78. Depth locator 46 and adjustment collar 44 are telescopically adjustable relative to each other through their threaded connection when adjustment collar 44 is rotated relative to nose portion 42 and nonrotatable, axially slidable depth locator 46. When adjustment collar 44 is rotated, depth locator 46 is axially advanced inwardly or outwardly relative to screwdriver bit 20, thereby adjusting the depth to which a fastener 22 can be axially advanced before clutch plates 28, 30 separate and drive power to bit 20 is discontinued.

In operation, to adjust the depth adjusting subassembly 40, adjustment collar 44 is rotated relative to nose portion 42 and axially slidable, nonrotatable locator 46. Through the threaded connection between adjustment collar 44 and depth locator 46, rotation of adjustment collar 44 telescopically advances depth locator 46 inwardly or outwardly relative to bit tip 20. The axial projection of bit holder 32 relative to bit 20 controls the depth which a screw 22 will be driven into a workpiece 24 before internal clutch mechanism 26 is disengaged. Internal clutch mechanism 26 is engaged by an axial bias applied to bit 20 through pushing bit 20 against screw 22 being driven into workpiece 24 to overcome the bias of spring 35. In this regard, spring 35 biases clutch plates 28, 30 into a normally disengaged position. When the seating of screw 22 into workpiece 24 is almost completed, the work-piece engaging portion 62 of depth locator 46 is engaged with the workpiece 24. After engagement of portion 62 with the surface and when bit 20 continues to progressively axially advance fastener 22 deeper and deeper into workpiece 24, the operator can no longer maintain the axial bias on bit 20 necessary to retain internal clutch mechanism 26 engaged. As a result, clutch plates 28, 30 are disengaged under the bias of spring 35.

Often it is desirable to remove adjustment collar 44 and depth locator 46 from nose portion 42 when driving a fastener into a confined or restricted location or when reengaging clutch mechanism 26 to drive the screwdriver in reverse to remove a screw 22. Such removal is facilitated by removing depth adjusting subassembly 40 as a unit through axial urging of adjustment collar 44 to the left as indicated in FIG. 3 by arrow A. As adjustment collar 44 is pulled to the left, the cooperative relationship of the portion of the inner circumferential wall 54 defining circumferential groove 70 and the configuration of outwardly extending ribs 94 serve to direct a portion of the axial force exerted in the direction of arrow A in a radial direction. This radial component of force causes the radial projections 94 to flex cantilevered spring fingers 100, 102, 104 of arcuate spring members 48 so as to permit arcuate ribs 94 to be disengaged from annular groove 70. As discussed above, adjustment collar 44 may be similarly reattached by axially sliding adjustment collar 15 to the right in FIG. 3 to radially contract arcuate spring members 48 to permit ribs 94 to be reengaged in annular groove 70.

Thus, depth adjusting system 18 of the present invention provides an improvement over the various prior designs by providing a system for a power tool which can change screwdriver bits without disturbing a previously-selected depth setting. As shown in FIG. 3, depth adjusting subassembly 40 is removed simply by axially urging adjustment collar 44 out of its snap-action engagement with nose portion 42. Since there involves no turning motion in removal of depth adjusting subassembly 40, the axial position of depth locator 46 relative to adjustment collar 44 remains unchanged. Importantly, because arcuate retaining ribs 94 and detent projections 98 are located on a hardened steel arcuate spring member 48, they are subject to less wear than retention mechanisms of prior art designs. Additionally, arcuate spring members 48 perform the retention and detent functions well with a relatively high dimensional tolerance. Furthermore, arcuate spring members 48 apply less force on adjustment collar 44 than in prior art designs and, therefore, adjustment collar 44 is also subject to less wear. As a result, adjustment collar 44 and depth locator 46 can be more easily attached to and removed from nose portion 42 reliably over a longer period of time than prior art designs.

Having described the elements and operations of the depth adjusting system 18 of the present invention, it can be appreciated that it is not restrictive for use with power tools, but is also appropriate for use with manually operated tools. That is because the depth adjusting system 18 of the present invention is completely independent of the drive means or of the type of tool bit used (i.e., screwdriver, nut-runner, etc.). However, for purposes of illustration, the depth adjusting system 18 of the present invention is shown and described in use with a power screwdriver 10. shown in FIG. 1.

Furthermore, it will be understood by those skilled in the art that the present invention is not limited to a system 18 incorporating two arcuate spring members 48. In other words, this particular construction which is shown and described herein should be considered to be merely exemplary. It is anticipated that a single arcuate spring member 48 can be utilized to releasably attach the depth adjusting subassembly 40. Likewise, three (3) or more arcuate spring members could also be employed to establish releasable interconnection.

While the above description constitutes the preferred embodiment of the invention, it will be appreciated that the invention is susceptible to modification, variation, and change without departing from the proper scope or fair meaning of the accompanying claims.

What is claimed is:

1. A depth adjusting system for a power tool having a housing, the depth adjusting system comprising:

a nose portion connected to the housing;

a depth adjusting subassembly releasably connected to the nose portion, the subassembly including an adjustment member mounted for rotatable non-axial movement relative to the nose portion during depth adjusting movement of the adjustment member; and a joining member for establishing releasable interconnection between the subassembly and the nose portion, the joining member including a substantially rigid portion engaging the subassembly and a resilient portion for biasing the substantially rigid portion into engagement with the subassembly.

2. The depth adjusting system of claim 1 wherein the adjustment member includes a cylindrical portion having an inner circumferential wall defining a circumferential groove, and further wherein the substantially rigid portion comprises a rib portion for engaging the circumferential groove.

3. The depth adjusting system of claim 2 wherein the resilient portion comprises a cantilevered spring finger.

4. The depth adjusting system of claim 3 wherein the joining member comprises a first arcuate spring member attached to the nose portion.

5. The depth adjusting system of claim 4 wherein the first arcuate spring member includes a plurality of cantilevered spring fingers in engagement with the nose portion.

6. The depth adjusting system of claim 4 wherein the first arcuate spring member is formed to integrally include a detent projection and further wherein the inner circumferential surface of the adjustment member includes a plurality of axially extending recesses for receiving the detent projection, such that the detent projection and the axially extending recesses cooperate to positively locate the adjustment member axially with respect to the nose portion.

7. The depth adjusting system of claim 5 further comprising a second arcuate spring member attached to the nose portion, the second arcuate spring member being substantially identical to the first arcuate spring member.

8. The depth adjusting system of claim 7 wherein the first and second arcuate spring members each include a pair of inwardly extending catch portions for engaging a pair of axially extending channels formed in the nose portion.

9. The depth adjusting system of claim 7 wherein each of the first and second arcuate spring members is integrally constructed of hardened steel.

10. A power screwdriver having a motor mounted within a housing for rotatably driving a screwdriver bit, the housing having a circular opening formed in a forward portion thereof for releasably receiving a depth adjusting system for adjustably controlling the depth to which a threaded fastener is installed into a workpiece, the depth adjusting system comprising an adjustment collar rotatably coupled to the opening in the housing and including a cylindrical portion having an inner circumferential surface, a substantially cylindrical depth locator surrounding the bit and threadably connected to the adjustment collar and constrained from rotating relative to the housing so that rotation of the adjustment collar causes axial displacement of the depth locator relative to the bit, and an interface for releasably interconnecting the housing and the depth adjusting system; the improvement wherein the interface includes:

a circumferential groove formed in the inner circumferential surface; and a first arcuate spring member attached to the housing and disposed adjacent the inner circumferential surface of the cylindrical portion, the first arcuate spring member including an outwardly extending rib portion adapted for engaging the circumferential groove.

11. The power screwdriver of claim 10 wherein the first arcuate spring member includes a biasing portion for biasing the outwardly extending rib portion into engagement with the circumferential groove.

12. The power screwdriver of claim 11 wherein the biasing portion includes a plurality of cantilevered spring fingers integrally connected to the first arcuate spring member.

13. The power screwdriver of claim 12 wherein the first arcuate spring member includes a first wall and a second wall, and further wherein the plurality of cantilevered spring fingers includes a first cantilevered spring finger extending adjacent the first wall and second and third cantilevered spring fingers extending adjacent the second wall.

14. The power screwdriver of claim 13 wherein the interface further comprises a second arcuate spring member attached to the housing, the second arcuate spring member being substantially identical to the first arcuate spring member.

15. The power screwdriver of claim 14 wherein the interface further comprises a detent projection integrally formed in each of the first and second arcuate spring members and a plurality of axially extending channels formed in the inner circumferential surface of the adjustment collar for receiving the detent projections, such that the detent projections and the axially extending channels cooperate to positively locate the adjustment member axially with respect to the housing.

16. The power screwdriver of claim 14 wherein each of the first and second arcuate spring members is constructed of hardened steel.

17. A depth adjusting system for a power screwdriver having a housing, the depth adjusting system comprising:

a nose portion connected to the housing;

a depth adjusting subassembly for establishing a predetermined depth for setting a threaded fastener into a workpiece, the depth adjusting subassembly releasably connected to the nose portion and including a) an adjustment collar rotatably coupled to the nose portion for non-axial movement relative to the nose portion during depth adjusting movement, the adjustment collar including an inner circumferential surface defining a circumferential groove; and b) a depth locator threadably connected to the adjustment collar and constrained from rotating relative to the nose portion so that rotation of the adjustment collar causes axial displacement of the depth locator; and a pair of substantially identical arcuate spring members attached to the nose portion, each of the arcuate spring members including at least one arcuate rib adapted to engage the circumferential groove of the adjustment collar.

18. The depth adjusting system of claim 17 wherein each of the arcuate spring members further includes a plurality of cantilevered spring fingers outwardly biasing the respective arcuate spring member.

19. The depth adjusting system of claim 18 wherein the inner circumferential wall further includes a plurality of axially extending recesses and further wherein each of the arcuate spring members further includes at least one detent projection, such that the detent projections and the axially extending recesses cooperate to positively locate the adjustment member axially with respect to the nose portion.

20. The depth adjusting system of claim 19 wherein the pair of arcuate spring members are unitarily constructed of hardened steel.

* * * * *